US006541080B1

(12) United States Patent
Pies

(10) Patent No.: US 6,541,080 B1
(45) Date of Patent: Apr. 1, 2003

(54) DOUBLE-DIP PD/SN CROSSLINKER

(75) Inventor: Peter Pies, Cologne (DE)

(73) Assignee: Enthone Inc., West Haven, CT (US)

( * ) Notice: Subject to any disclaimer, the term of this patent is extended or adjusted under 35 U.S.C. 154(b) by 0 days.

(21) Appl. No.: 09/857,755

(22) PCT Filed: Dec. 14, 1999

(86) PCT No.: PCT/US99/30124

§ 371 (c)(1),
(2), (4) Date: Sep. 19, 2001

(87) PCT Pub. No.: WO00/36189

PCT Pub. Date: Jun. 22, 2000

(30) Foreign Application Priority Data

Dec. 14, 1998 (DE) ..... 198 57 290

(51) Int. Cl.[7] ..... C08J 7/18; B05D 3/04; C25D 5/54

(52) U.S. Cl. ..... 427/532; 427/304; 205/159

(58) Field of Search ..... 205/159; 427/532, 427/304

(56) References Cited

U.S. PATENT DOCUMENTS 4,590,115 A * 5/1986 Cassat ..... 428/174

FOREIGN PATENT DOCUMENTS

DE 195 10 855 3/1995
DE 195 10 855 A1 * 9/1996

* cited by examiner

*Primary Examiner*—Edna Wong
(74) *Attorney, Agent, or Firm*—Senniger, Powers, Leavitt & Roedel

(57) ABSTRACT

Process for the direct metallizing of the surface of a plastic object. The surface of the plastic object is roughened by pickling. The surface is activated with the aid of a colloidal or ionogenic aqueous solution of a first precious metal, which colloidal or ionogenic aqueous solution also contains a second base metal. This forms an activation coat on the surface containing the first precious and the second base metals. Electron conductivity of the activation coat is provided with the aid of a treatment solution, with which the second base metal is at least partially dissolved out of the activation coat and an electron conducting substance is adsorb in the activation coat. Then the electron-conductive activation coat is metallized. Before the electron conducting activation coat is metallized, the sequence of steps "activation of the surface and establishment of electronic conductivity" is repeated at least once.

19 Claims, 2 Drawing Sheets

DOUBLE-DIP PD/SN CROSSLINKER

The invention concerns a process for the direct metallizing of the surface of a plastic object, using these steps:

roughening the surface of the plastic object by pickling;

activating the surface with the aid of a colloidal or ionogen aqueous solution of a first precious metal, which colloidal or ionogenic solution also contains a second base metal, whereby an activating coat containing the first precious and second base metal is formed on the surface; and providing electron conductivity on the activating coat with the aid of a preferably alkaline treatment solution, with which the second base metal is at least partially dissolved out of the activating coat and an electron-conductive substance is adsorbed in the activation coat;

whereby the electron-conductive activation layer is then metallized.

The invention thus concerns a process for the direct galvanic metallizing of a plastic surface. Of course, it is part of the invention that several plastic objects can be metallized at the same time with the process under the invention. Plastics metallized in this way are used for decorative purposes, for example in the health sector or in automobile manufacturing. Metallizing of plastics is also performed as part of the coating of electronic components for the purpose of electromagnetic shielding. In principle, different plastics can be galvanically metallized. For example, the surface of plastic such as acrylonitrile-butadiene-styrene (ABS) and, where necessary, blends of ABS and polycarbonates (PC) can be metallized for decorative purposes.

The known process of the type named at the beginning, from which the invention starts (DE 195 10 855 C2), is used for the partial or selective electrolytic metallizing of the surfaces of acrylonitrile-butadiene-styrene copolymer substrates. After the surface of the plastic is roughened by pickling with chromic sulfuric acid, chrome (VI) is reduced to chrome (III) as part of the process, This is followed by activation in a colloidal acid solution of palladium, which contains additional tin compounds. On the base of the activation coat created, sufficient electron conductivity is produced for the subsequent metallization. For this, a tin/copper exchange is performed. The treatment solution used for this contains copper ions, which are bound by a biologically degradable complex forming substance. The tin/copper exchange is based on a charge exchange, in which tin (II) is oxidized by the copper ions to tin (IV) and whereby the copper ions themselves are reduced to metallic copper and deposited on palladium clusters on the surface of the plastic. As a result of this deposition of copper, the palladium clusters which formed during activation with the colloidal solution become electron-conductive. This known process is characterized by a number of disadvantages. First, only limited quantities of palladium/tin can be applied to the roughened plastic surface with this process. There are corresponding limits to the metallization of these plastic surfaces. In addition, only ABS or ABS blends can normally be metallized with some degree of acceptability with this process. The metallization of ABS blends in particular leaves much to be desired. The metallization can often not be performed with any degree of reproducibility, and frequently certain areas on the surface of the plastic object to be metallized are not covered with an adequate metal coat. If plastic objects composed of different plastics are to be metallized with the known process, only ABS or ABS blends are metallized as a rule.

By contrast, the invention is based on the technical problem of describing a process of the type named at the beginning, with which different plastics can be metallized safely and reproducibly, and in which the plastics are given a metal coat which meets all requirements.

To solve this technical problem, the invention defines a process as described above which is characterized by the repetition of at least once of the sequence of steps "activation of the surface according to step 1.2) and making the activation layer electron-conductive according to step 1.3)" before the metallizing of the electron-conductive activation coat. It is part of the invention that steps 1.2) and 1.3) are repeated several times before the metallizing of the electron-conductive activation coat.

The invention is based on the finding that metallizing of plastic objects that is especially safe and effective can be achieved if the theory according to patent claim 1 can be realized. By repeatedly performing steps 1.2) and 1.3), the volume of adsorbed precious metal/base metal on the surface of the plastic can be increased substantially—surprisingly as part of the activation. Unexpectedly, metal coats with outstanding quality can be applied to the plastic objects as a result. Surprisingly, a variety of different plastics can be metallized effectively and safely with the process under the invention. Besides ABS, ABS blends, particularly ABS/PC blends, can be metallized reproducibly and the resulting metal coats meet all requirements. As part of the invention, large plastic objects, for example large ABS/PC parts such as automotive radiator grills, can be metallized without difficulty. The surfaces of plastic objects consisting of a number of different plastics can be metallized without difficulty and, if desired, completely.

In another type of implementation of the invention, roughening the surface of the plastic object is carried out by pickling with chromic sulfuric acid. For practical terms, a solution containing 400 g/l chromic acid and 400 g/l sulfuric acid is used. Pickling can be carried out solely with chromic acid. It is part of the invention that after pickling with chromic sulfuric acid or chromic acid, chrome (VI) is removed as completely as possible from the surface of the roughened or etched surface. Preferably, intensive rinsing is performed first after the roughening of the surface. In accordance with a preferred type of implementation of the invention, chrome (VI) is reduced to chrome (III) after the pickling with chromic sulfuric acid or chromic acid. It is within the scope of the invention that this chrome reduction takes place after the aforementioned rinsing. Potassium bisulfide or potassium hyposulfite can be used, for example, for the reduction of chrome (VI) to chrome (III). Preferably, at least one rinsing takes places following the chrome reduction. In another version of the invention, roughening of the plastic surface is carried out by pickling with a permanganate solution. In yet another version, the roughening is achieved by plasma pickling.

It is within the scope of the invention that the surface of the plastic object is pretreated with acid by immersion before the activation of the surface in accordance with step 1.2). The acid is preferably a mineral acid, hydrochloric acid is the most preferred. For practical purposes, the pretreatment is performed by immersion in a concentrate of hydrochloric acid, preferably 30% by volume hydrochloric acid.

According to the very much preferred type of implementation within the scope of the invention, which is particularly important as part of the invention, the steps "pretreatment by immersion in an acid, activation of the surface in accordance with step 1.2) and providing electron conductivity in accordance with step 1.3)" are repeated at least once before metallizing the electron-conducting activation coat. In other words, following the roughening of the surface in accordance with 1.1), the steps "immersion—activation—providing electron conductivity" are performed in succession and then this sequence of steps "immersion—activation—providing electron conductivity" is repeated at least once. As part of the inventive process, this sequence of steps can be repeated several times, i.e. more than twice, before metallizing the electron-conducting activation coat. Following roughening in accordance with 1.1), the "immersion—activation—providing electron conductivity" steps can then be performed and subsequently only the sequence "activation—providing electron conductivity" is repeated at least once.

It is within scope of the invention that two different metallic elements are used in the colloidal or ionogenic aqueous solution to the activate the surface, namely a precious metal and a second base metal that is different from the first metal. In one version of the invention, the precious metal is palladium and the base metal is tin. For practical terms, a tin (II) stabilized palladium colloidal solution is used for activation. Palladium and tin are adsorbed from this solution on the pretreated surface of the plastic object. Preferably, a hydrochloric acid palladium-tin solution is used to activate the surface. In accordance with the version described previously, the activation coat consists of a palladium-tin coating. Preferably, an acidic, most preferably a hydrochloric acid, colloidal aqueous solution is used in the inventive process. It is within the scope of the invention that rinsing is performed after the activation of the surface.

As part of the invention, providing electron conductivity on the activation coat means sufficient electron conductivity of the activation coat for the subsequent metallizing. That, according to step 1.3), the second base metal is at least partially dissolved out of the activation coat and an electron-conductive substance is adsorbed in the activation coat, means, according to one version of the invention, that the second base metal, for example tin, is partially or completely dissolved out of the activation coat and replaced with an electron-conducting substance, for example another metal. That an electron-conducting substance is adsorbed in the activation coat also means, according to another version of the invention, that the second base metal is dissolved at least partially out of the activation coat and an electron-conducting substance is formed in the activation coat. So it is within the scope of the invention that as the result of treatment with the preferably alkaline solution, a reaction with the second base metal takes place and an electron-conducting substance, respectively an electron-conducting compound, is formed in the activation coat. Through adsorption of the electron-conducting substance, a type of cross-linking of the activation coat with the electron-conducting substance takes places. In one version of the invention, the second base metal is replace with a third metal to establish the electron conductivity of the activation coat. It is within the scope of the invention that the second base metal in the activation coat has an oxidation level >0. This second metal occurring in an "oxidized form" is replaced in practical terms by the third metal, which, preferably in an elementary metallic form, ensures the electron conductivity of the activation coat. For practical terms, the second base metal is replaced by a third metal, which is precious compared with the second one. The third metal is preferably copper. In this version, the treatment solution contains copper ions, which are preferably bonded by a complex forming substance. The base metal bonded to the plastic surface, preferably tin, is exchanged for copper in the treatment solution. In practical terms, tin (II) ions are oxidized by the copper ions to tin (IV). The copper ions themselves are reduced to metallic copper and bonded to the plastic surface. This gives the surface adequate electrical conductivity, so that direct metallizing of the plastic can be carried out afterwards. The electron-conducting substance, which partially or completely replaces the second base metal from the activation coat, does have to be a metal as part of the invention, but not absolutely. For the purpose of establishing the electron conductivity of the activation coat, a preferably alkaline treatment solution of electron conducting compounds of elements from the 6th and/or 7th main group of the periodic system, or mixtures of them, is used in another type of implementation of the invention. It is within the scope of the invention that, in this version, the electron conducting substance in the activation coat is formed by chemical reaction, for example with a second base metal.

When sufficient electron conductivity has been established in the activation coat, direct metallizing of the surface of the plastic object can take place. It is within the scope of the invention that direct electrolytic metallizing is carried out. In one version of the invention, a copper coat is applied to the electron conducting activation coat by means of electrolytic metallizing. In another type of the invention, a nickel coat is applied to the electron conducting activation coat by means of electrolytic metallizing. It is part of the invention that other metal coats, for example a chrome coat, can be applied to the electron conducting activation coat as part of metallizing. It is evident that not just one metal coat can be applied, but a number of metal coats can be applied in succession.

Substantial and surprising benefits are achieved as a result of repeating steps 1.2) and 1.3) of the invention before metallizing, or preferably, by repeating the steps "immersion using an acid—activation of the surface—providing electron conductivity." As was already demonstrated above, considerably greater quantities of precious and base metal, for example palladium/tin, can—surprisingly—be deposited on the surface of plastic objects as an activation coat, in comparison to the known process explained at the beginning. Surprisingly, this is possible with many different plastics, even with ABS blends in particular. The process of the invention also makes it possible to save considerably quantities of the precious metal, for example palladium. If the aforementioned steps are repeated twice as described in the invention, a colloidal or ionogenic aqueous solution can be used, which, in comparison to the known process explained at the beginning, contains only half the concentration of the precious metal, for example of palladium. So large quantities of the normally very expensive precious metal can be saved, with great benefit. Nevertheless, equal amounts or ever greater amounts of the metals, palladium and tin for example, can be applied to the surface as the activation layer. On the other hand, the invention shows that with the same concentration of the precious metal in the colloidal or ionogenic solution, only half the activation time is required, if the appropriate steps in the process are repeated twice as described in the invention and the same amount of precious metal is applied to the surface as in the known process. After metallizing, metal coats with optimal surface qualities are achieved using the process of the invention. There are almost no failures in coverage. Larger plastic surfaces can be metallized easily. It is even possible to metallize ABS blends effectively and safely.

BRIEF DESCRIPTION OF THE DRAWINGS

The invention is explained in greater detail below, using drawings. The schematic representations show:

FIG. 1 shows the adsorption of palladium/tin that is achieved by using the known process explained at the beginning on the surface of a plastic object. Curve 1 shows the adsorption on the surface of an ABS plastic object, and Curve 2 shows the adsorption on the surface of an ABS/PC plastic object. The plastic objects were first pickled in a solution of 400 g/l of chromic acid and 400 g/l of sulfuric acid, and then a reduction of chrome (VI) to chrome (III) was carried out. Then came a pre-immersion in a 300 ml/l concentration of hydrochloric acid. Activation followed afterwards in a tin (II) stabilized palladium colloidal solution. It can be seen in FIG. 1 that the palladium/tin adsorption increases at the greatest rate in the first 3 minutes. After 5 minutes no additional palladium/tin is deposited on the surface of the plastic object. Even when higher concentrations of the colloidal aqueous solution are chosen, greater adsorption of palladium/tin cannot be achieved. It can also be seen in FIG. 1 that only a slight, unsatisfactory adsorption of palladium/tin takes place on the surface of the ABS/PC object. Following activation, the surface of the plastic object was treated with a solution in accordance with step 1.3). Then electrolytic copper plating or electrolytic nickel plating was carried out.

FIG. 2 shows the adsorption of palladium/tin on the surface of plastic objects using the process from the invention. Curve 3 shows the adsorption of palladium/tin on an object made of ABS, and Curve 4 shows the adsorption on an object made of ABS/PC. With the process from the invention, the procedure was initially basically the same as with the known process described previously. However, after the first time the treatment was carried out according to step 1.3), steps "pre-immersion in the hydrochloric acid—activation in the palladium solution—treatment in accordance with 1.3" were repeated once. The dividing line 5 in FIG. 2 shows the end of the first sequence of steps and the beginning of the second sequence of steps. In FIG. 2, it can be seen clearly that the result with the process from the invention is that about twice the amount of palladium/tin is adsorbed in comparison with the known process, both on the object made of ABS as well on the object made of ABS/PC. This has to come as a surprise to the expert. With the process from the invention, unexpectedly large amounts of palladium/tin can also be adsorbed on ABS/PC blends and other ABS blends, permitting surprisingly effective and safe subsequent metallizing. If the aforementioned steps are repeated more than twice, the content of adsorbed palladium/tin can be increased still further. Unexpected benefits are achieved in the result with the process from the invention.

Figure 1:
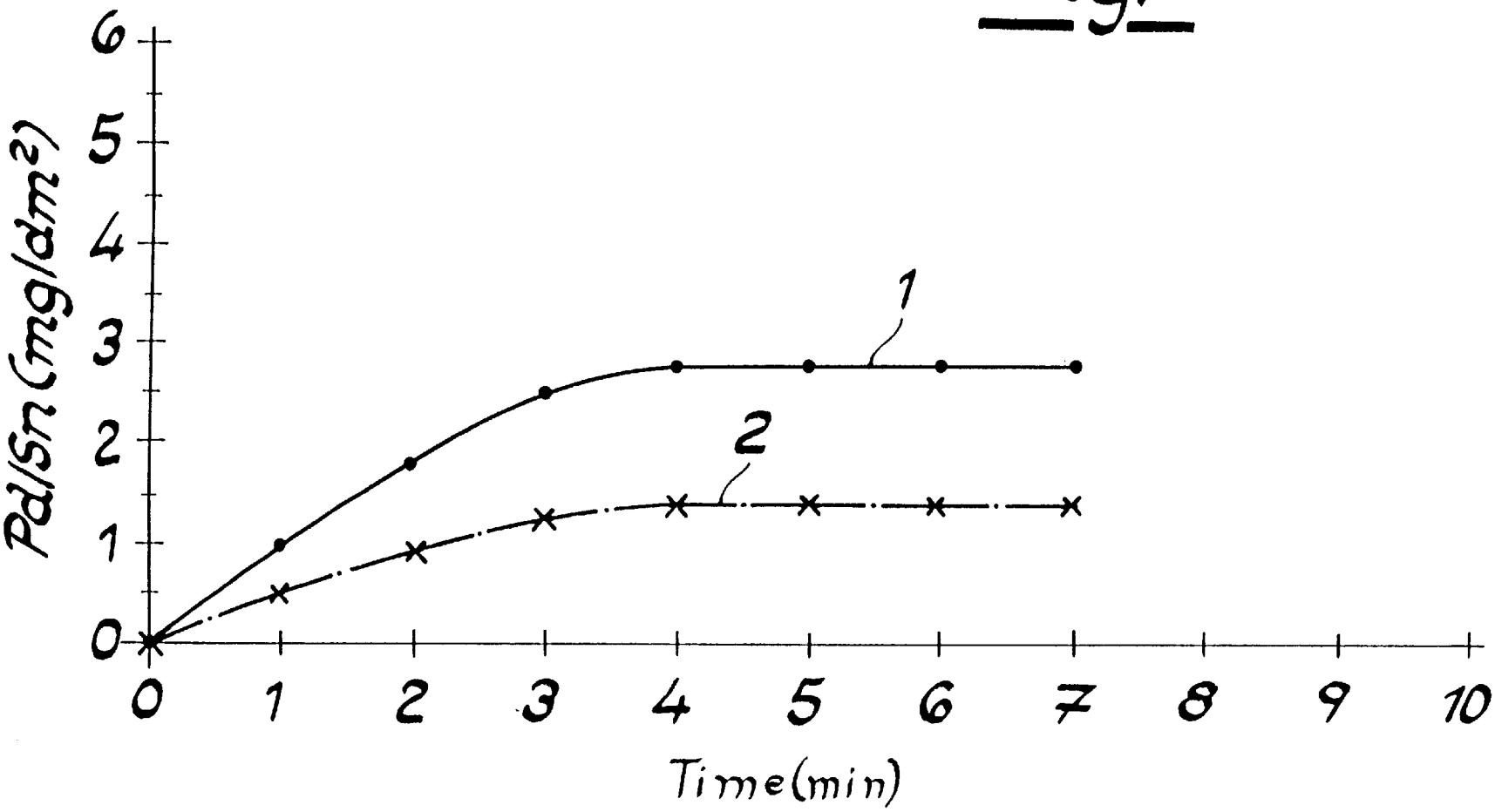
FIG. 1, which illustrates the time-dependent adsorption of palladium/tin on the surface of a plastic object using the known state-of-the-art process, wherein the x-axis represents time expressed in minutes, and the y-axis represents the paliadium/tin adsorption expressed in mg/dm$^2$.
Figure 2:
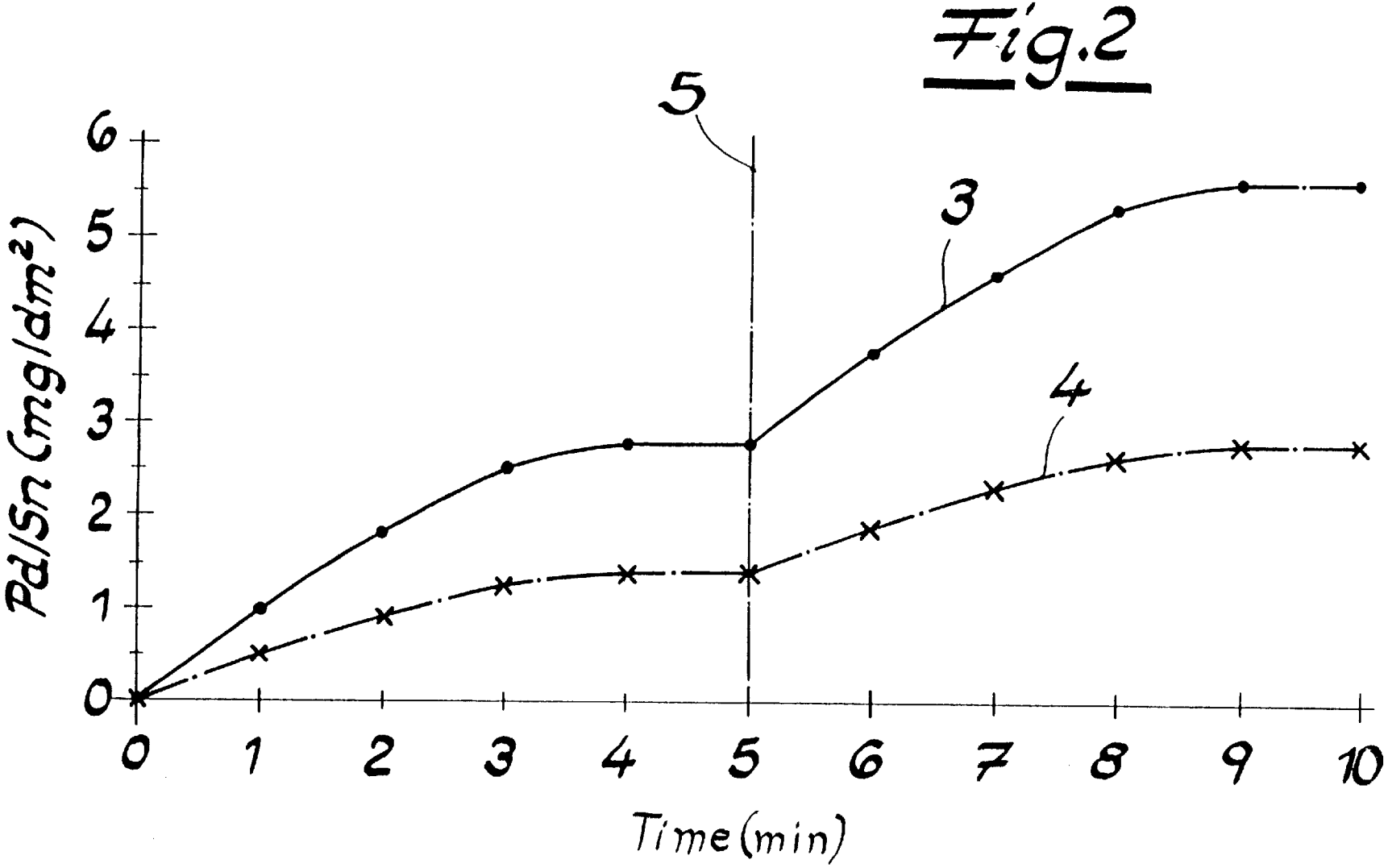
FIG. 2, which illustrates the time-dependent adsorption of palladium/tin on the surface of a plastic object using the process of the invention, wherein the x-axis represents time expressed in minutes, and the y-axis represents the palladium/tin adsorption expressed in mg/dm$^2$.

What is claimed is:

1. A process for direct metallizing of a surface of a plastic object comprising:

roughening the surface of the plastic object by pickling;

activating the surface of the plastic object with the aid of a colloidal or ionogenic aqueous solution of a first precious metal, which colloidal or ionogenic solution additionally contains a second base metal, whereby an activation coat containing the first precious metal and the second base metal is formed on the surface;

providing electron conductivity on the activation coat with the aid of an alkaline treatment solution, with which the second base metal is dissolved at least partially from the activation coat, and an electron conducting substance is absorbed in the activation coat;

contacting the activation coat having the electron conducting substance absorbed therein with colloidal or ionogenic aqueous solution of the first precious metal, which colloidal or ionogenic solution additionally contains the second base metal;

providing further electron conductivity on the activation coat by further contacting with the alkaline treatment solution, with which the second base metal is further dissolved at least partially from the activation coat, and the electron conducting substance is further absorbed in the activation coat; and metallizing the activation coat after said further contacting with the alkaline treatment solution.

2. The process of claim 1 wherein the alkaline treatment solution comprises compounds of elements selected from among elements of periodic table group 6, periodic table group 7, and mixtures thereof.

3. The process of claim 1 wherein the alkaline treatment solution comprises copper compounds.

4. The process of claim 1 wherein the second base metal is tin and the alkaline treatment solution comprises copper compounds.

5. A process for direct metallizing of a surface of a plastic object comprising:

roughening the surface of the plastic object by pickling;

immersing the surface in a mineral acid after said roughening;

after said immersing, activating the surface of the plastic object with the aid of a colloidal or ionogenic aqueous solution of a first precious metal, which colloidal or ionogenic solution additionally contains a second base metal, whereby an activation coat containing the first precious metal and the second base metal is formed on the surface;

providing electron conductivity on the activation coat with the aid-of an alkaline treatment solution, with which the second base metal is dissolved at least partially from the activation coat, and an electron conducting substance is absorbed in the activation coat;

contacting the activation coat having the electron conducting substance absorbed therein with colloidal or ionogenic aqueous solution of the first precious metal, which colloidal or ionogenic solution additionally contains the second base metal;

providing further electron conductivity on the activation coat by further contacting with the alkaline treatment solution, with which the second base metal is further dissolved at least partially from the activation coat, and the electron conducting substance is further absorbed in the activation coat; and metallizing the activation coat after said further contacting with the alkaline treatment solution.

6. The process of claim 5 wherein the mineral acid is hydrochloric acid.

7. The process of claim 5 wherein the alkaline treatment solution comprises compounds of elements selected from among elements of periodic table group 6, periodic table group 7, and mixtures thereof.

8. The process of claim 5 wherein the alkaline treatment solution comprises copper compounds.

9. The process of claim 5 wherein the second base metal is tin and the alkaline treatment solution comprises copper compounds.

10. A process for direct metallizing of a surface of a plastic object comprising:

roughening the surface of the plastic object by pickling;

activating the surface of the plastic object with the aid of a colloidal or ionogenic aqueous solution of a first precious metal, which colloidal or ionogenic solution additionally contains a second base metal, whereby an activation coat containing the first precious metal and the second base metal is formed on the surface;

providing electron conductivity on the activation coat with the aid of an alkaline treatment solution, with which the second base metal is dissolved at least partially from the activation coat, and an electron conducting substance is absorbed in the activation coat;

after said providing electron conductivity, immersing the surface in a mineral acid;

contacting the activation coat having the electron conducting substance absorbed therein with colloidal or ionogenic aqueous solution of the first precious metal, which colloidal or ionogenic solution additionally contains the second base metal;

providing further electron conductivity on the activation coat by further contacting with the alkaline treatment solution, with which the second base metal is further dissolved at least partially from the activation coat, and the electron conducting substance is further absorbed in the activation coat; and metallizing the activation coat after said further contacting with the alkaline treatment solution.

11. The process of claim 10 wherein the mineral acid is hydrochloric acid.

12. The process of claim 10 wherein the alkaline treatment solution comprises compounds of elements selected from among elements of periodic table group 6, periodic table group 7, and mixtures thereof.

13. The process of claim 10 wherein the alkaline treatment solution comprises copper compounds.

14. The process of claim 10 wherein the second base metal is tin and the alkaline treatment solution comprises copper compounds.

15. A process for direct metallizing of a surface of a plastic object comprising:

roughening the surface of the plastic object by pickling;

after said roughening, immersing the surface in a mineral acid;

after said immersing, activating the surface of the plastic object with the aid of a colloidal or ionogenic aqueous solution of a first precious metal, which colloidal or ionogenic solution additionally contains a second base metal, whereby an activation coat containing the first precious metal and the second base metal is formed on the surface;

providing electron conductivity on the activation coat with the aid of an alkaline treatment solution, with which the second base metal is dissolved at least partially from the activation coat, and an electron conducting substance is absorbed in the activation coat;

after said providing electron conductivity, immersing the surface in a mineral acid;

contacting the activation coat having the electron conducting substance absorbed therein with colloidal or ionogenic aqueous solution of the first precious metal, which colloidal or ionogenic solution additionally contains the second base metal;

providing further electron conductivity on the activation coat by further contacting with the alkaline treatment solution, with which the second base metal is further dissolved at least partially from the activation coat, and the electron conducting substance is further absorbed in the activation coat; and metallizing the activation coat after said further contacting with the alkaline treatment solution.

16. The process of claim 15 wherein the mineral acid is hydrochloric acid.

17. The process of claim 15 wherein the alkaline treatment solution comprises compounds of elements selected from among elements of periodic table group 6, periodic table group 7, and mixtures thereof.

18. The process of claim 15 wherein the alkaline treatment solution comprises copper compounds.

19. The process of claim 15 wherein the second base metal is tin and the alkaline treatment solution comprises copper compounds.

* * * * *